US007938258B2

(12) United States Patent
Saravanane et al.

(10) Patent No.: US 7,938,258 B2
(45) Date of Patent: May 10, 2011

(54) CONTAINER ASSEMBLY

(75) Inventors: Radjendirane Saravanane, Pondicherry (IN); Senravan Ramasamy, Folsom, CA (US); Sankarakumara Sivaramakrishna Pillai, Chennai (IN)

(73) Assignee: E.I.D. Parry (India) Limited, Chennai (IN)

( * ) Notice: Subject to any disclaimer, the term of this patent is extended or adjusted under 35 U.S.C. 154(b) by 819 days.

(21) Appl. No.: 11/543,557

(22) Filed: Oct. 5, 2006

(65) Prior Publication Data

US 2008/0083779 A1 Apr. 10, 2008

(51) Int. Cl.
*B65D 25/08* (2006.01)

(52) U.S. Cl. ..... 206/221; 206/219; 222/129

(58) Field of Classification Search ..... 206/219–222; 222/129, 130, 325

See application file for complete search history.

(56) References Cited

U.S. PATENT DOCUMENTS

| | | | | | |
|---|---|---|---|---|---|
| 1,706,335 | A | * | 3/1929 | Toch | 220/506 |
| 2,719,628 | A | * | 10/1955 | Ivanoff | 206/221 |
| 3,156,369 | A | | 11/1964 | Bowes et al. | |
| 3,743,520 | A | * | 7/1973 | Croner | 426/87 |
| 3,797,646 | A | * | 3/1974 | Horne | 206/219 |
| 4,195,730 | A | | 4/1980 | Hunt | |
| 4,221,291 | A | | 9/1980 | Hunt | |
| 4,386,696 | A | | 6/1983 | Goncalves | |
| 4,615,437 | A | | 10/1986 | Finke et al. | |
| 4,705,191 | A | | 11/1987 | Itzel et al. | |
| 4,793,475 | A | * | 12/1988 | Itzel | 206/221 |
| 4,832,230 | A | | 5/1989 | Janowitz | |
| 4,903,828 | A | * | 2/1990 | Finke et al. | 206/221 |
| D308,166 | S | | 5/1990 | Weckman | |
| 5,257,650 | A | | 11/1993 | Fisk et al. | |
| 5,439,141 | A | | 8/1995 | Clark et al. | |
| D362,806 | S | | 10/1995 | Mason et al. | |
| D363,020 | S | | 10/1995 | Mason, Jr. et al. | |
| 5,465,835 | A | * | 11/1995 | Schumacher et al. | 206/221 |
| D367,815 | S | | 3/1996 | Mason, Jr. et al. | |
| 5,529,216 | A | | 6/1996 | Klima et al. | |
| D389,412 | S | | 1/1998 | Klima, Jr. et al. | |
| D391,488 | S | | 3/1998 | Klima, Jr. et al. | |
| D396,641 | S | | 8/1998 | Klima, Jr. et al. | |
| 5,811,060 | A | | 9/1998 | Laguna Valderrama | |
| D399,751 | S | | 10/1998 | Klima, Jr. et al. | |
| 5,836,479 | A | | 11/1998 | Klima et al. | |
| 5,871,122 | A | | 2/1999 | Klima et al. | |
| 5,890,624 | A | | 4/1999 | Klima et al. | |

(Continued)

*Primary Examiner* — Kenneth Bomberg
*Assistant Examiner* — Robert K Nichols, II
(74) *Attorney, Agent, or Firm* — Kilyk & Bowersox, P.L.L.C.

(57) ABSTRACT

A container assembly includes exterior storage recesses or other accommodating spaces or members into which one or more cartridges may be removably inserted for the storage of chemical compounds. In various embodiments, one or more storage containers may contain a liquid and a solid component or a crystalline or powder and a solid component to be mixed in an interior of the container body, for example with water or other liquid, to form an activated compound. That compound or solution may be or include a pesticide, herbicide, fungicide, fuel mixture, cleaner, or other end product. The storage cartridges containing the ingredients may be configured to threadedly engage an outer cap which attaches to an opening in the container body. The outer cap and the threads of the ingredient-storing compartments may be counter threaded, so that when the outer cap is attached to the attachment opening of the container body, the storage compartments detach and drop into the interior of the container, releasing the ingredients for mixture and use. The separation of potentially volatile ingredients improves the shelf life of pesticides and other end product or solutions.

16 Claims, 8 Drawing Sheets

U.S. PATENT DOCUMENTS

| | | | | |
|---|---|---|---|---|
| D411,748 | S | 6/1999 | Klima, Jr. et al. | |
| 5,927,549 | A | 7/1999 | Wood | |
| 5,944,223 | A | 8/1999 | Klima et al. | |
| 5,947,332 | A | 9/1999 | Klima, Jr. et al. | |
| 5,950,819 | A | 9/1999 | Sellars | |
| 6,041,969 | A | 3/2000 | Parise | |
| 6,073,808 | A | 6/2000 | Klima et al. | |
| 6,148,996 | A | 11/2000 | Morini | |
| 6,152,326 | A | 11/2000 | Klima, Jr. et al. | |
| 6,182,865 | B1 | 2/2001 | Bunschoten et al. | |
| 6,230,884 | B1 | 5/2001 | Coory | |
| 6,250,511 | B1 | 6/2001 | Kelly | |
| 6,290,100 | B1 | 9/2001 | Yacko et al. | |
| 6,319,453 | B1 | 11/2001 | Klima, Jr. et al. | |
| 6,431,402 | B1 | 8/2002 | Klima et al. | |
| 6,533,113 | B2 | 3/2003 | Moscovitz | |
| 6,540,109 | B1 | 4/2003 | Klima et al. | |
| 6,568,562 | B1 | 5/2003 | Klima, Jr. et al. | |
| 6,644,471 | B1 | 11/2003 | Anderson | |
| 6,679,375 | B1 | 1/2004 | Coory | |
| 6,719,130 | B1 | 4/2004 | Wagner | |
| 6,921,087 | B2 | 7/2005 | Takahashi et al. | |
| 6,935,493 | B2 | 8/2005 | Cho | |
| 7,159,741 | B2 * | 1/2007 | Dehn et al. | 222/83.5 |
| 2001/0011661 | A1 | 8/2001 | Klima et al. | |
| 2002/0066679 | A1 | 6/2002 | Moscovitz | |
| 2003/0000961 | A1 | 1/2003 | Klima et al. | |
| 2004/0040619 | A1 * | 3/2004 | Dehn et al. | 141/110 |
| 2004/0112770 | A1 | 6/2004 | Oswald | |
| 2004/0159562 | A1 | 8/2004 | Takahashi et al. | |
| 2004/0238566 | A1 | 12/2004 | Stank et al. | |
| 2005/0173271 | A1 * | 8/2005 | Levi | 206/219 |
| 2008/0023349 | A1 * | 1/2008 | Balazik | 206/222 |

* cited by examiner

CONTAINER ASSEMBLY

FIELD OF THE INVENTION

The present invention relates to the field of container design.

BACKGROUND OF THE INVENTION

Pesticides, fuels, paints, cleaning agents, and other liquid products or materials are often packaged in containers having a spray nozzle or other spraying, storage, or delivery mechanism. Liquid product containers are often filled with liquid contents at the time of manufacture. Many materials such as pesticides, paints, and other materials may, however, not be chemically stable for long periods of time, and therefore experience a comparatively short shelf life. To reduce the difficulties in manufacturing, packaging, storing, shipping, and retailing liquid products with a comparatively brief shelf life, a container assembly capable of storing the ingredients (or parts thereof) of a pesticide, fungicide, pest/microorganism control material, paint, fuel, cleaner or other material for mixing and dispensing closer to the time of use would be desirable.

SUMMARY OF THE INVENTION

The present invention overcoming these and other problems in the art relates in one regard to a container assembly. The container assembly includes an integral external storage recess or other storage or accommodating member, in which one or more removable cartridges may be stored. According to various embodiments, the one or more removable cartridges may include one, two, or more storage compartments that store ingredients to be mixed and dispensed to create an end product, such as a pesticide, fungicide, or other types of pest and/or microorganism control material, or other material active against pests or microorganisms, paint, fuel, solvent, cleaner, or other chemically activatable product. According to various embodiments of the present invention in one regard, the one or more cartridges storable in the container assembly may be releasably engageable with an opening in the container body. Upon engagement of one or more of the cartridges with the opening in the container body, an interior storage compartment or compartments attached to the cartridge can be automatically released into the body of the container. According to various embodiments, the storage compartment or compartments released from the cartridge may be pre-loaded with a gas, liquid, solid, or other material, or combination of materials, for release in the interior cavity of the container. According to various embodiments, the inner cavity of the container may contain water or other fluid or solution into which the stored ingredient or ingredients may be released and combined. In certain embodiments, the released ingredients may be combined in solution to form an active pesticide and/or fungicide (or other microbicide) (e.g., having the desired concentration), cleaner, dye, paint, fuel, or other solution, emulsion, or compound for spray or other delivery. The shelf life of the product can therefore be significantly extended, since the composition ingredients can be conveniently retained in an inactivated state in the container assembly until the user decides to combine and use them. Storage, transport, and marketing costs may therefore be reduced substantially. In addition, transportation of premixed liquids, such as pesticides, cleaners, and other hazardous chemicals, can be an occupational and public hazard and the present invention can eliminate such issues. The present invention also provides combination products, involving two or more ingredients, for a specific benefit, such as pesticides, fungicides, paints, fuels, and the like that solve issues of shelf stability and storage.

BRIEF DESCRIPTION OF THE DRAWINGS

Embodiments of the present invention will be described with reference to the accompanying drawings, in which like numerals refer to like elements.

DETAILED DESCRIPTION OF EMBODIMENTS

Figure 1:
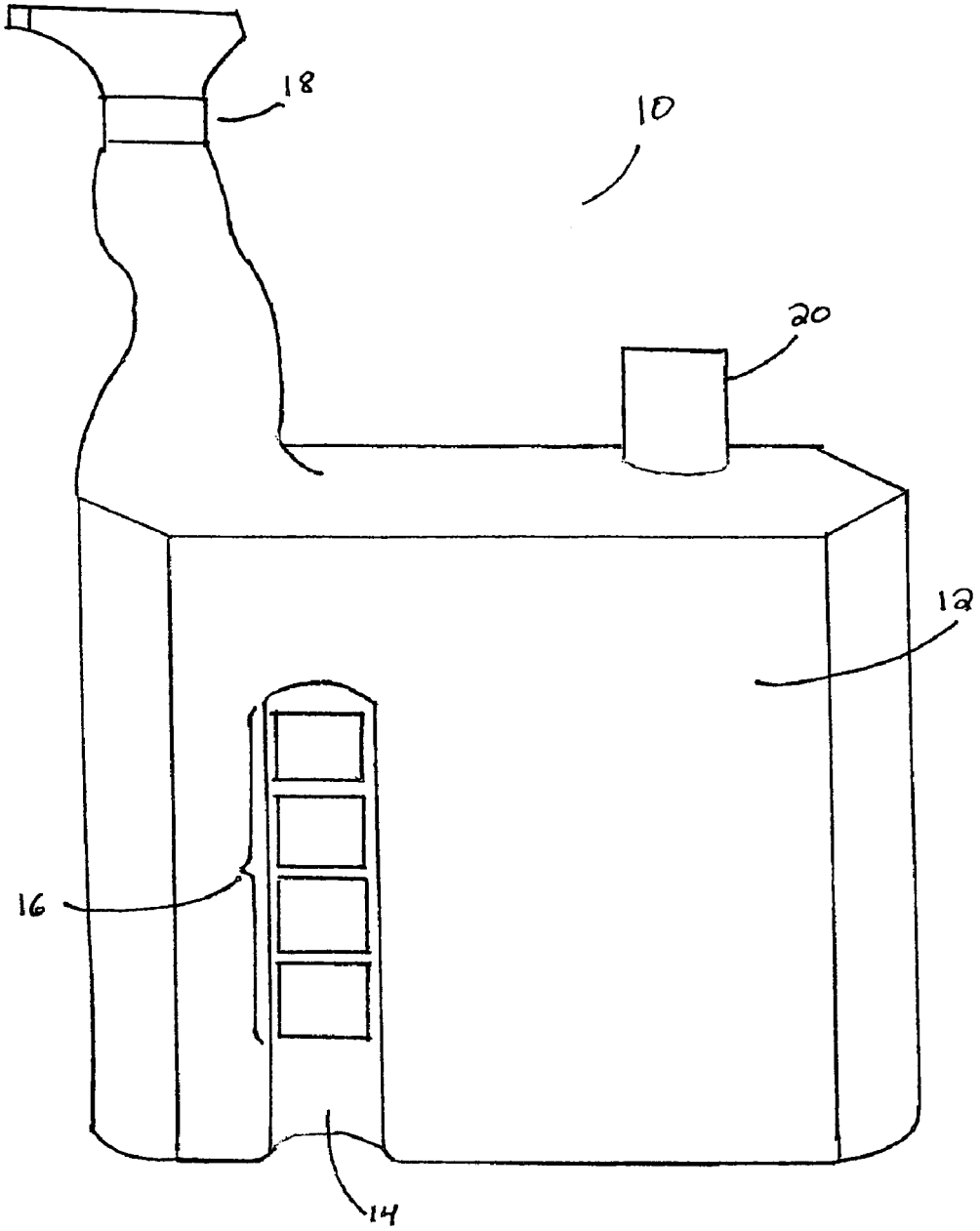
FIG. 1 illustrates a container assembly according to certain embodiments of the present invention, in a side view.

A container assembly 10 according to various embodiments of the present invention is illustrated in FIG. 1. The container assembly 10 can include a container body 12, such as an elongated canister or flask-shaped hollow body, or other shapes or configurations of containers. According to various embodiments, the container body 12 may be formed from plastic such as high-density polyethylene (HDPE), or other polymeric material (e.g., thermoplastics or thermosets), metal, glass, paper/cardboard, or other material capable of being formed into a container to hold a material. In various embodiments, the container body 12 may contain an inner usable volume of 0.25 liters to 5 liters, or greater or lesser volumes or capacities. According to various embodiments, the container body 12 may be suitable to accept and hold liquids (e.g., aqueous or non-aqueous), powders, particulates, solids, gases, or other substances or materials. Specific examples include water, alcohol, oil, gasoline, solvents, paints, dyes, medical products, gases, industrial products, consumer products, or other material.

According to various embodiments, one or more storage recesses 14 or other storage or accommodating space or member can be formed in and be a part of the container body 12. According to various embodiments, the one or more storage recesses 14 may be formed in an exposed exterior surface of the container body 12. According to various embodiments, the one or more storage recesses 14 each can consist of a hollow cylindrical recess or bore, or other space, or groove, or channel formed in the exterior surface of container body 12. The shape of the recess can be any shape or size (e.g., cylindrical, rectangular) to accommodate one or more cartridges. The location of the recess can be any where, such as on a side(s) of the container. More than one recess can be present in different locations on the container, such as one or more recesses on one or more sides of the container, or one or more recesses spaced apart from each other but on the same side of the container, and so on. The size of the recess can be made to receive any size cartridge(s), and can depend on the number of cartridges to be attached to the container and the amount of material(s) to be present in the cartridge(s).

According to various embodiments, and as illustrated in FIG. 1, the container assembly 10 can also contain one or more removable storage cartridges 16 which can be stored in the one or more storage recesses 14. In various embodiments as shown, the set of storage cartridges 16 can be generally cylindrical storage members which may be removably inserted into the one or more storage recesses 14. The cartridges can have any shape or be any size as in the case of the recesses. The cartridges can have a rectangular, elliptical, or other geometric shape with the recess being shaped in a reciprocal manner to receive and hold the cartridge(s). In various embodiments, the set of storage cartridges 16 can for instance be formed in close dimension to the one or more storage recesses 14, to form a friction fit with the interior of the recess. It will be understood that while FIG. 1 illustrates the set of storage cartridges 16 as including a set of four cartridges, other numbers of storage cartridges, such as one, two, three, five, six, or more, or other numbers, can be used. It will also be appreciated that while FIG. 1 illustrates the set of one or more storage recesses 14 as the one cylindrical bore, that other numbers, configurations, combinations, or types of storage recesses or other storage space or other storage accommodating member may be formed in the container body 12. For example, in various embodiments the one or more storage recesses 14 can comprise one or two or more generally parallel cylindrical bores formed in one side of the container body 12, or in further embodiments, can include one or more cylindrical or other recesses on each side of the container body 12, or recesses, spaces, or other storage spaces or accommodating members in other locations.

It will be further appreciated that while the cartridges in the set of storage cartridges 16 in FIG. 1 are illustrated as being generally of the same size or type, in various embodiments the set of storage cartridges 16 can include cartridges having different shapes, sizes, capacities, contents, or other characteristics.

According to various embodiments as likewise illustrated in FIG. 1, the container assembly 10 can also include a spray nozzle 18, such as a pump-action detachable nozzle or spout. In various embodiments, the spray nozzle 18 may, for example, be threadedly engaged (or otherwise engaged) to the container body 12, or, in various embodiments may be integrally formed with the container body 12. In various embodiments, spray nozzle 18 can also be configured, attached or formed in other ways. In further embodiments, the container body 12 can be formed without a spray nozzle 18 or other dispensing mechanism such as a hose on sprayer systems or connectable to any size spray equipment or liquid delivery systems. As also illustrated in FIG. 1, the container assembly 10 can include an attached cartridge 20, for example, removably taken from the set of storage cartridges 16. The attached cartridge 20 can contain and detachably release one, two, or more ingredients or components into the interior cavity of the container body 12, as described herein.

Figure 2:
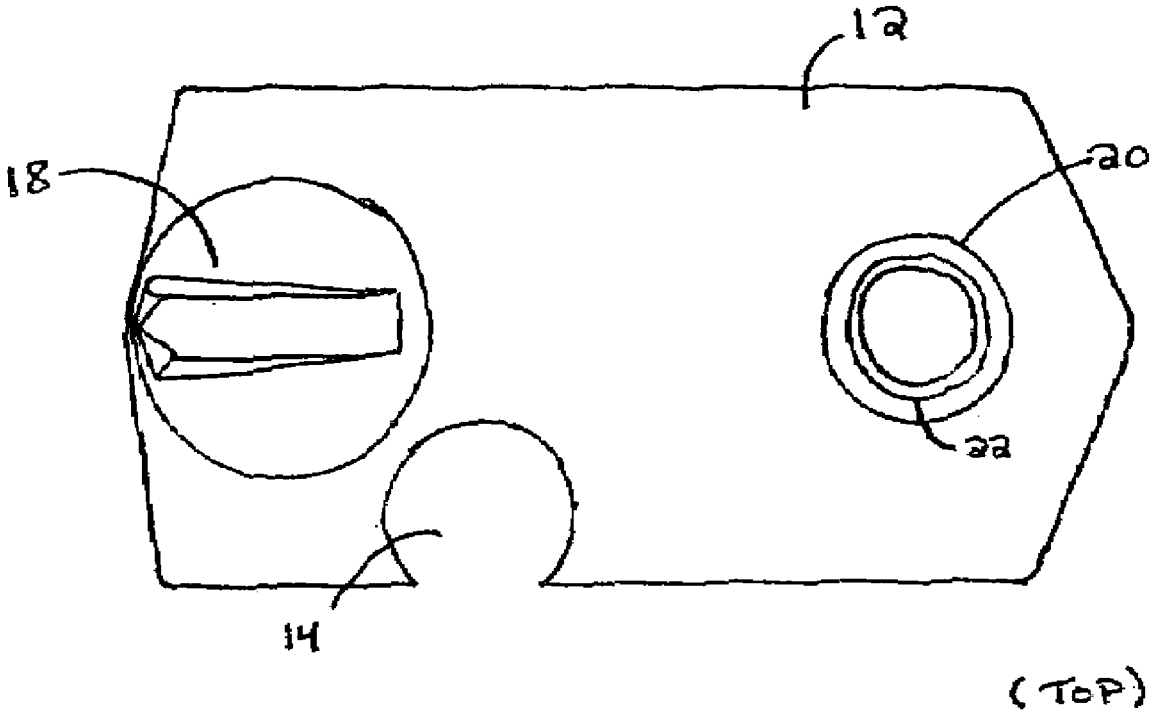
FIG. 2 illustrates a container assembly according to certain embodiments of the present invention, in a top view.
Figure 3:
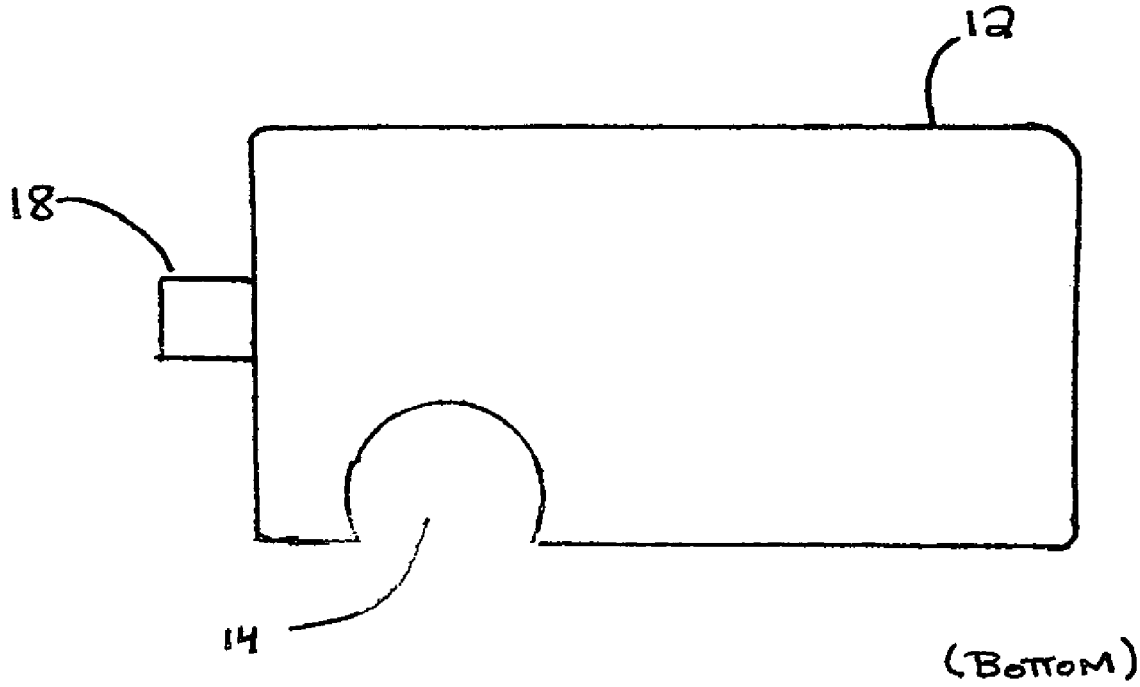
FIG. 3 illustrates a container assembly according to certain embodiments of the present invention, in a bottom view.

FIG. 2 illustrates a container assembly 10 according to various embodiments of the present invention, in a top view. According to various embodiments of the present invention as shown in FIG. 2, the container body 12 can have formed therein an attachment neck 22, for example, a threaded cylindrical neck formed in a top portion of the container body 12. According to various embodiments, the attached cartridge 20 can connect or engage with the container body 12 via the attachment neck 22, for example through engaging threads, or other attachment mechanisms. According to various embodiments as also shown in FIG. 2, the attachment neck 22 can be formed adjacent to the spray nozzle 18, but in other embodiments, can be formed or disposed in other suitable areas of container body 12. According to various embodiments as likewise illustrated in FIG. 2, the one or more storage recesses 14 can be formed as a cylindrical (or other shape) bore extending along an exterior side wall of the container body 12. As for example further illustrated in FIG. 3, the one or more storage recesses 14 can extend along a portion of the vertical height of the container body 12, or entire height of container body 12, including an exposed lower mouth or opening formed in a bottom of the container body 12. Other lengths, shapes, and/or configurations of the one or more storage recesses 14 can be used. According to various embodiments, additional cartridges can be removed from or inserted into the set of storage cartridges 16 from either the top or the bottom of the one or more storage recesses 14, or both.

Figure 4:
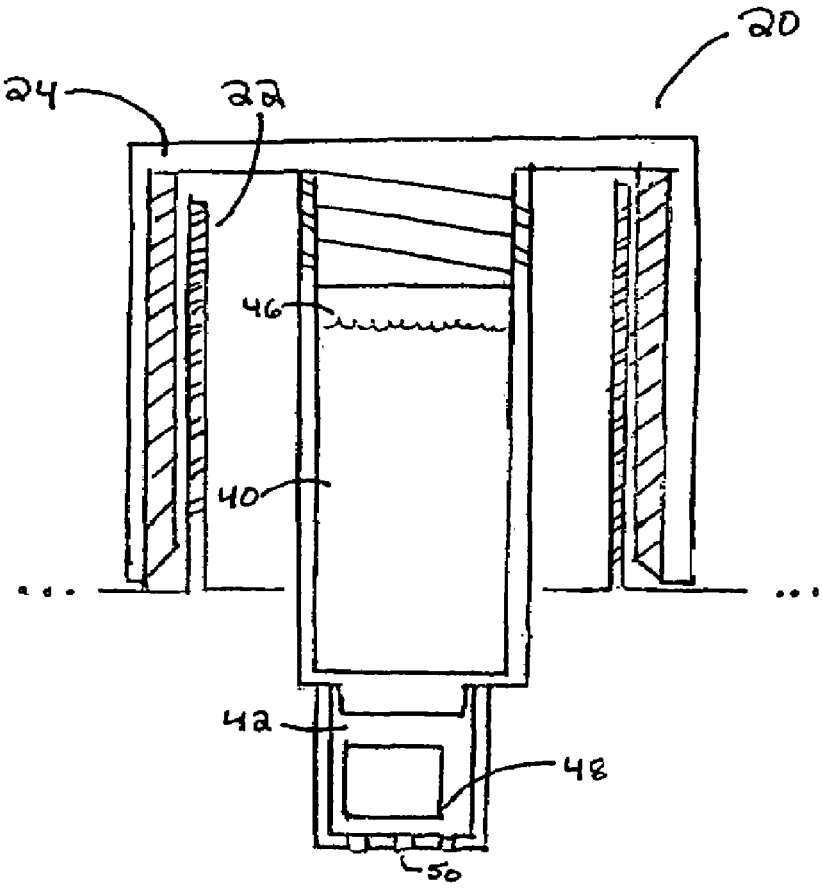
FIG. 4 illustrates a cartridge assembly usable in certain embodiments of the container assembly of the present invention, in a side view.

As illustrated in FIG. 4, the attached cartridge 20 engaged (or any storage cartridge 16 engaged or unengaged) with the attachment neck 22 can contain or include a number of components. Those components can include an outer cap 24 which projects from the container body 12, upon attachment of the attached cartridge 20 with the attachment neck 22. According to various embodiments, the outer cap 24 and other components of cartridge 20 can be formed of polymeric material (e.g., thermoplastic or thermoset), for example, polypropylene, or other plastic, glass, metal, paper/cardboard, or other material.

According to various embodiments, the attached cartridge 20 and the set of storage cartridges 16 can each contain one or more stored materials, ingredients, additives, or other substances for release into the container body 12. As illustrated, for example, in FIG. 4, the attached cartridge 20 and the set of storage cartridges 16 can each include one or more storage compartments, for example, a liquid-containing compartment 40 and/or a solid-containing compartment 42. According to various embodiments, the liquid-containing compartment 40 and/or solid-containing compartment 42 can be joined by a snap-fit or other connection of two or more separable compartments. According to various embodiments, the liquid-containing compartment 40 can store or contain a liquid 46 such as an active ingredient, a surfactant, emulsifier, sticker, pesticide, microbicide (e.g., fungicide), herbicide, an oil, acid, solvent, aqueous solution, or other agricultural/garden/grass/soil chemical, or other liquid material. According to various embodiments, the solid-containing compartment 42 can contain a solid 48 such as a powder, tablet, or other solid material or form. The solid can be an active ingredient, a surfactant, emulsifier, sticker, pesticide, microbicide (e.g., fungicide), herbicide, an oil, acid, solvent, aqueous solution, or other agricultural/garden/grass/soil chemical, or other solid-containing material. According to various embodiments, the liquid-containing compartment 40 and the solid-containing compartment 42 (if both are present) can be fluidly separated from each other, for instance, by an impermeable bottom floor (e.g., made from same or different material as the cartridge body, such as polymeric (e.g., HDPE injection grade/acrylic butastyrene, polypropylene), metal (e.g., foil), paper, a film, glass, and the like) in the liquid-containing compartment 40, so as to avoid contamination or mixture of liquid 46 and solid material 48 while in storage or otherwise. In various embodiments, other numbers and types of compartments can be incorporated in the cartridge. For example, according to various further embodiments, any one or more of the attached cartridge 20 and the set of storage cartridges 16 can incorporate one storage compartment, rather than two or another number.

According to embodiments, the liquid-containing compartment 40 can have a hollowed (or other shaped) cylindrical interior and have a liquid (or solid) capacity of 0.1 ml to 50 ml, or less or more volume. The liquid 46 stored in the liquid-containing compartment in various embodiments can have a weight of up to about 5 g, or less or more weight. Other shapes of the interior cavity for the compartment(s) can be used. According to various embodiments, the liquid-containing compartment 40 can include multiple chambers or other subdivisions, for example to store more than one liquid or other material in one or more different chambers. According to various embodiments, the liquid 46 can be or include biological material.

According to various embodiments, the solid material 48 stored in solid-containing compartment 42 can be or include, for example, a tablet or tablets, a pellet or pellets, a powder, granules, flakes, crystals, or other substances or material or any combinations thereof. According to various embodiments, the solid material 48 stored in solid-containing compartment 42 can have a weight of 0.1 mg, or less or more weight (e.g., 0.01 mg to 5 g or more). According to various embodiments, the solid material 48 can be or include biological material. According to various embodiments, the solid-containing compartment 42 can contain multiple chambers or other subdivisions, for example to store more than one solid material in one or more different chambers. According to various embodiments, the liquid-containing compartment 40 can also or instead store solid or gaseous material, and according to various embodiments, the solid-containing compartment 42 can also or instead store liquid or gaseous material. Other storage combinations are possible. The compartments can be made from polymeric materials, glass, ceramics, paper/cardboard, metal, and the like, such as polypropylene, such as HDPE with or without acrylic butastyrene.

According to various embodiments, the attached cartridge 20 and the set of storage cartridges 16 can each be configured such that upon engagement of the cartridge body to the attachment neck 22 of the container body 12, the liquid-containing compartment 40 and the solid-containing compartment 42 can be detached (e.g., as a unitary piece or multiple pieces) and released into the interior cavity of the container body 12. According to various embodiments as illustrated in FIG. 5, the detachment and release of one or more compartments can be effected by a counter-threading mechanism which releases the compartments of the attached cartridge 20, when the attached cartridge 20 engages the attachment neck 22.

Figure 5:
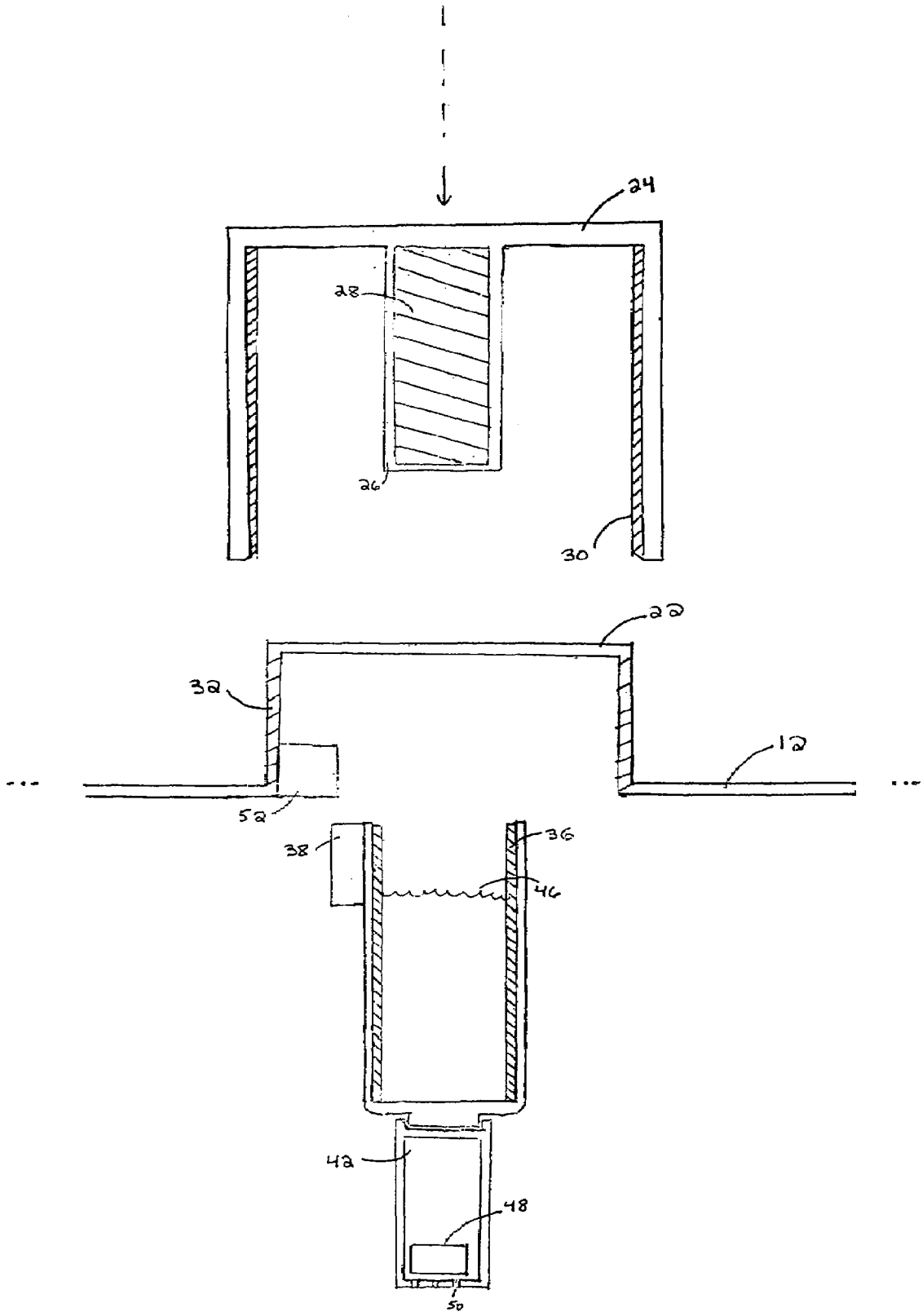
FIG. 5 illustrates a cartridge assembly usable in certain embodiments of the container assembly of the present invention, in an exploded side view.

More specifically, and as further illustrated in FIG. 5, the outer cap 24 attached to the attached cartridge 20 and to the set of storage cartridges 16 can each have a set of threads 30 formed in an interior annular portion thereof. The outer cap 24 can also include an annular or cylindrical protrusion 26, the outer surface of this annular or cylindrical protrusion which has a set of threads 28 generally threaded in an opposite direction to the set of threads 30. According to various embodiments, the attachment neck 22 of the container body 12 can have a set of threads 32 which threadedly engage the set of threads 30 on the interior of the outer cap. According to various embodiments, the liquid-containing compartment 40 can have a set of threads 36 formed on an inner cylindrical surface of the liquid-containing compartment 40, the set of threads 36 being configured to threadedly engage the set of threads 28 of the cylindrical protrusion 26 of the outer cap 24.

As the outer cap 24 descends in threaded engagement with the set of threads 32 of the attachment neck 22 in screw-down fashion, a rib 38 formed on an outer surface of the liquid-containing compartment 40 may strike or catch a catch 52, such as a wedge-shaped protrusion, formed in the interior rim of the attachment neck 22. The continued turning of the outer cap 24 against the rib 38 caught or stopped against the catch 52 causes the set of threads 36 of the liquid-containing compartment 40 to begin to threadedly disengage the set of threads 28 on the cylindrical protrusion 26 of the outer cap 24. The catch can be any length or thickness or shape. The catch can extend the length of the internal neck 22.

Upon sufficient turning of the outer cap 24 to fully extend the liquid-containing compartment 40 down the set of threads 28 on the cylindrical protrusion 26 of the outer cap, the liquid-containing compartment 40 clears the set of threads 28 and the liquid-containing compartment 40 along with the joined solid-containing compartment 42 detaches from the outer cap 24 and drops into the interior of the container body 12. Upon release of the liquid-containing compartment 40 and joined solid-containing compartment 42 into the interior of the container body 12, a liquid 46 contained in the liquid-containing compartment 40 may be released into the interior of the container body 12. The unthreading of the liquid-containing compartment 40 removes the liquid tight seal between the top of the liquid-containing compartment and the outer cap 24 that essentially held the liquid-containing compartment, thereby leaving an open-ended container for the liquid to escape. According to various embodiments, the interior container body 12 can be filled or partially filled with water, oil, fluid, hydrocarbon-containing products, fuel, particulate, gas, or other material. According to various embodiments, the water or other material in the interior of container body 12 can be filled by a user, can be filled at time of manufacture, or at other times. Marks on the container can indicate the level of liquid or other material that can be added to achieve a desired concentration of the overall formulation in the container. The liquid can be added to the container prior to or after the release of the compartment(s) containing the material(s) to be dispensed with the liquid in the container.

According to various embodiments, solid-containing compartment 42 can be formed on a bottom surface thereof of a perforated grill 50 or other set of through-holes, channels, or other conduits, or other liquid-permeable layer or material. For purposes of the present invention, the term "grill" encompasses any liquid-permeable wall. The grill 50 can expose solid material 48, such as a tablet or powder, through the grill 50 into the water or other contents held in container body 12. In further embodiments, the solid-containing compartment 42 can optionally be formed of a water-soluble film, wall, or other material which dissolves upon contact with water or other solvent or liquid, to expose the solid material 48 to the water or other fluid or other contents in container body 12. In this manner, the liquid 46 and the solid material 48 can be released, dispersed, dissolved, or mixed with the water or other fluid or other contents in the container body 12. According to various embodiments, the liquid 46 and the solid material 48 may dissolve or combine to form an activated end product when combined or activated in this fashion. The container can be shaken to enhance the mixing or dispersion of the liquid and/or solid released from the compartment(s).

For example, according to various embodiments, the liquid 46 and the solid material 48 may dissolve, disperse, mix, or otherwise be combined to create or activate an end product which is or which contains a pesticide or pest suppressing agent, microbicide, herbicide, or other bioactive material. According to various embodiments, end products active against pests formed and applied according to the invention including pesticides and pest-suppressing agents. According to various embodiments, pesticides and other end products or materials active against pests can include all kinds of synthetic or chemical pesticides, which can include organophosphate pesticides, carbamate pesticides, organochloride insecticides, and pyrethroid pesticides. According to various embodiments, end products active against pests/diseases/weeds formed and applied according to the invention can include biopesticides, which can include microbial pesticides, plant-incorporated protectants, and biochemical pesticides.

According to various illustrative embodiments, the solid material 48 can be or include an amount of azadirachtin A, and the liquid 46 can be or include an oil such as sesame oil, a surfactant, and/or other liquids or solutions. When the solid 48 is or includes azadirachtin A and the liquid 46 is or includes an oil such as sesame oil and a surfactant, those materials may combine in water or other solution in the body of the container body 12 to form an anti-pest formulation known commercially as NEEMAZAL™ product. According to various embodiments, it will be understood, however, that other end products active against pests, as well as further kinds of end products other than material active against pests, may be formed. For example, other synthetic or biochemical material active against pests may be formed by the combination of the liquid 46, solid material 48, and/or other additional ingredients. Other end products, for example, such as microbicides, herbicides, fertilizers, cleaners, fuels or fuel/oil mixtures, paints, dyes, or other solutions, emulsions, reactants, or other materials or end products may be formed. The formulations described in U.S. Pat. Nos. 6,811,790 and 6,340,484 can benefit from the present invention, and these patents are incorporated herein in their entirety by reference.

According to various embodiments, once the ingredients have dissolved or otherwise combined in solution in water (or other medium) or otherwise in the interior of container body 12, a user can, in various embodiments, dispense or apply the resulting solution or material, for example, by spraying that solution or material through spray nozzle 18. Other techniques of applying the resulting solution or material can be used, including pouring or squeezing that material on a desired target or area. The container can use the attachment neck as the single opening to the interior cavity of the container, and the container like this can be used as a container to make a concentrate to be used in a variety of ways, such as to add to a larger tank or sprayer. The single opening can be used for multiple purposes, such as to receive the cartridge, and can be used to receive a spray head. The cap on the cartridge can be used as a closure means even after the compartments are released into the container. The combined solution or material can be applied or dispensed immediately, or in various embodiments, can be stored for a period of time before use in container body 12 or other location. According to various embodiments, container body 12 can be formed without spray nozzle 18 and the combined and activated end product can be dispensed for use into another container (e.g., tank, sprayer, etc.).

In one or more embodiments of the present invention, the present invention permits the ability to formulate compositions or formulations for a variety of uses. The present invention permits the ability to provide the proper and accurate amount of active ingredient(s) or shelf-life sensitive material into a medium, such as a liquid medium, to create a formulation or composition having the proper concentration of the various ingredients. For example, with a pesticide or fungicide, the present invention permits one to use a cartridge to properly dilute the active ingredients in a liquid medium, such as water, to create the proper concentration or strength of the pesticide or fungicide. The cartridges ensure that the proper amount or dosage of active ingredient or other ingredients are properly mixed or dissolved or otherwise integrated with the medium, such as water or other medium or solvent, to create the proper concentration for the overall pesticide formulation. The container in which the liquid or other solvent or medium is included can have proper fill marks indicated on the outside of the container to ensure that the proper amount of liquid or other medium is filled prior to, during, or after the cartridge is received into the hollow interior of the container.

As another example of the present invention, the present invention can be useful in obtaining proper ratios of oil to fuel mixtures, such as oil to gasoline mixtures, for instance, in two-cycle combustion engines. For instance, the cartridge can be designed to have the proper amount of oil to make a desirable volume (or weight) ratio, such as 50:1, 32:1, or 40:1, with respect to gasoline to oil mixtures. The cartridge can be designed to have the proper amount to make the proper ratio dilutions with gasoline, wherein the container can contain gasoline at the proper amount for purposes of achieving the desired ratio in the gasoline. The shape of the container can be any shape, such as a conventional shape used for holding gasoline, and wherein the container can contain an attachment opening for receiving a cartridge as described herein. The container can contain a standard spout for discharging the contents of the gasoline:oil mixture. Further, the cap on the cartridge can even have imprinted on the cap or molded on the cap the particular ratio which the cartridge will make when added to a container containing gasoline.

The present invention thereby permits one to achieve the exact and accurate concentration of ingredients to make a variety of formulations, such as pesticides, microbicides, herbicides, gasoline:oil mixtures, and other chemical formulations where active ingredients are diluted into mediums, such as liquid mediums, such as solvents. The present invention permits these dilutions to occur without spills or any mess since the cartridge does not open until it is attached onto the container as described herein and, therefore, there is no need to pour active ingredients which creates the chance of spill, improper amounts, and the like. The present invention permits a lesser amount of exposure to chemical ingredients when diluting with other materials, such as liquid mediums.

Figure 6:
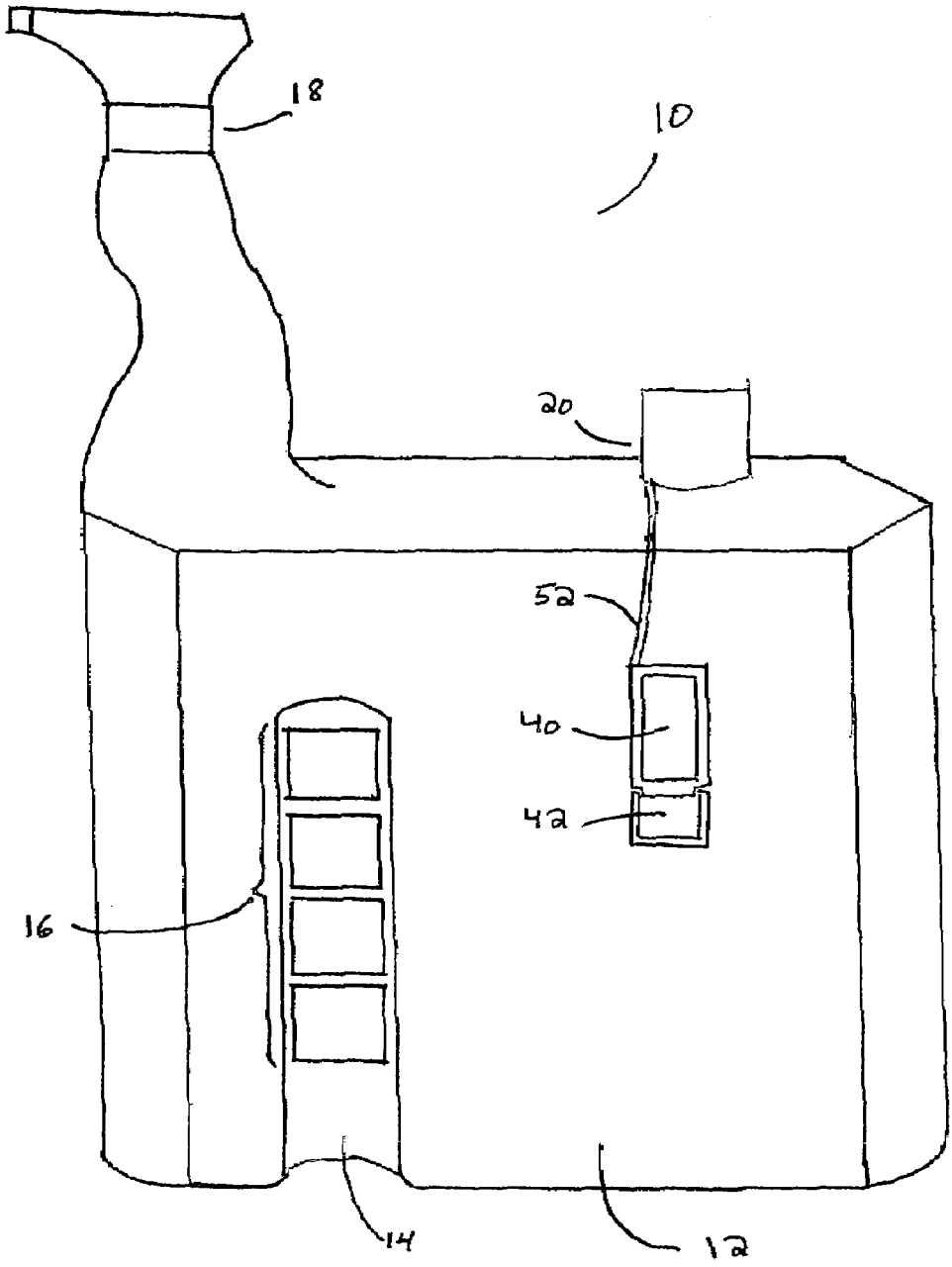
FIG. 6 illustrates a container assembly according to certain embodiments of the present invention including a retaining member, in a side view.

In further embodiments as illustrated, for example, in FIG. 6, upon detachment of the liquid-containing compartment 40 and the solid-containing compartment 42 from the outer cap 24, the joined compartments may be retained and connected with the outer cap 24 by a separate retaining member 52, so that the joined liquid-containing compartment 40 and solid-containing compartment 42 remain connected to the outer cap 24. According to various embodiments including a retaining member 52, the joined liquid containing compartment 40 and solid-containing compartment 42 can, for example, be extracted by pulling the outer cap 24 and retaining member 52 out through the attachment neck 22. According to various embodiments, the retaining member 52 can be or include a string, a thin plastic strip, a spring, or other member or material. In various embodiments as illustrated in FIG. 6, the ease of recovery of the joined liquid-containing compartment 40 and solid-containing compartment 42 can be facilitated. According to various embodiments, the liquid-containing compartment 40, the solid-containing compartment 42, or other compartments can be retrieved and reloaded with additional or other material after use. According to various further embodiments, the liquid-containing compartment 40 and the solid-containing compartment 42 may be integrally formed as one member, for instance, and loaded with liquid 46, a solid material 48, or other material, respectively, for example for one-time use.

Figure 7:
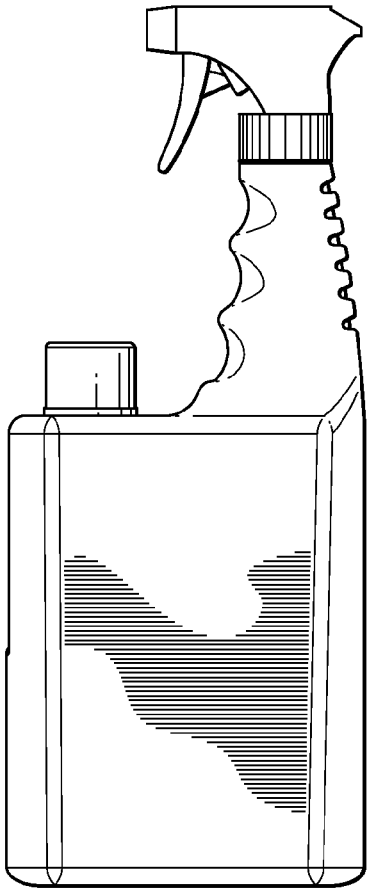
FIGS. 7-10 illustrate various views of certain embodiments of the present invention.
Figure 8:
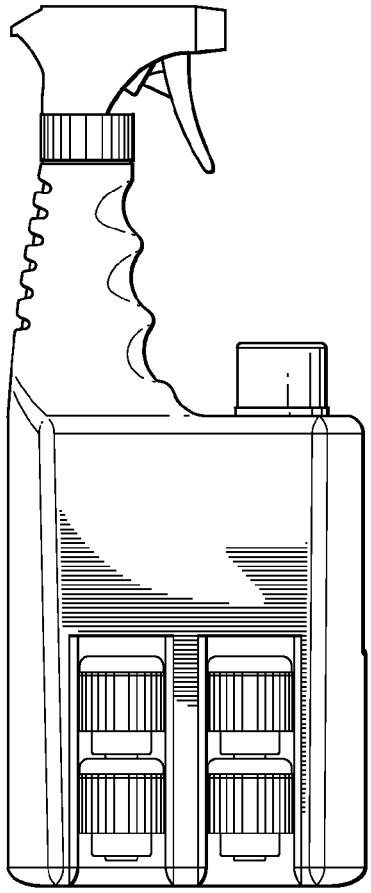
Figure 10:
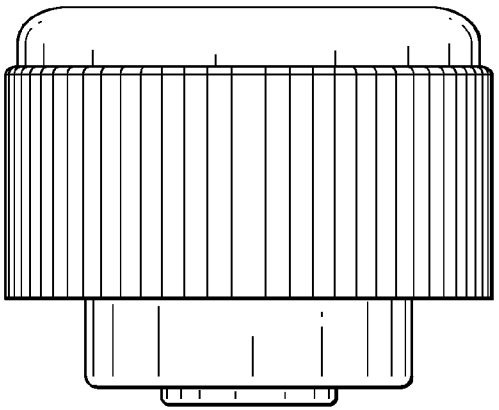
Figure 9:
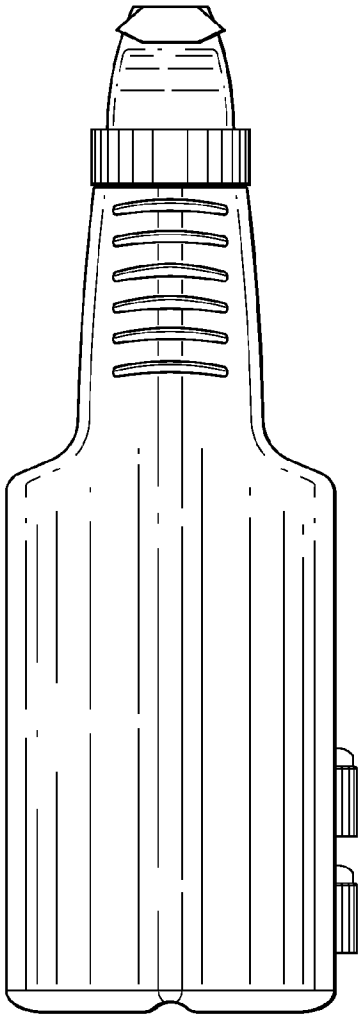

FIGS. 7-10 are further views of various embodiments of the present invention. FIG. 7 is a back view of the container assembly. FIG. 8 is a front view of the container assembly. FIG. 9 is a side view of the container assembly, and FIG. 10 is a front view of the cartridge.

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range or preferred value and any lower range limit or preferred value, regardless of whether ranges are specifically disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the specification and examples be considered as exemplary only, with a true scope and spirit of the present invention being indicated by the following claims and equivalents thereof.

What is claimed:

1. A container assembly comprising:

a container having a hollow interior, the container comprising an attachment opening and a threaded neck surrounding the attachment opening, the threaded neck comprising an outer surface and threads on the outer surface, an inner surface, and at least one catch protruding from the inner surface;

at least one cartridge comprising a cap and at least one detachable storage compartment threadedly engaging the cap, the cap comprising an inner surface and threads on the inner surface that releasably engage the threads on the outer surface of the threaded neck, and a cylindrical protrusion comprising an outer surface and threads on the outer surface of the cylindrical protrusion, the at least one detachable storage compartment comprising an inner surface and threads that releasably engage the threads on the outer surface of the cylindrical protrusion, and an outer surface comprising at least one outwardly protruding rib that engages the catch;

wherein the at least one detachable storage compartment comprises at least one liquid-containing compartment which further includes liquid and at least one solid-containing compartment which further includes a solid, wherein the at least one liquid-containing compartment and the at least one solid-containing compartment and the liquid-containing compartment being fluidly separated from the at least one solid-containing compartment; and wherein, upon engagement of the threads on the inner surface of the cap with the threads on the outer surface of the threaded neck, the at least one outwardly protruding rib of the at least one detachable storage compartment catches the catch of the threaded neck, thereby threadedly disengaging the at least one detachable storage compartment from the threads on the outer surface of the cylindrical protrusion of the cap, detaching the at least one detachable storage compartment from the cap of the at least one cartridge to release the at least one detachable storage compartment into the hollow interior of the container, and the solid-containing compartment comprises a perforated grill or a liquid-permeable layer adapted to expose the solid material contained in the solid-containing compartment to a fluid when present in the hollow interior of the container.

2. The container assembly of claim 1, wherein the at least one detachable storage compartment detaches completely from the at least one cartridge upon engagement of the at least one cartridge with the attachment opening.

3. The container assembly of claim 1, wherein the at least one detachable storage compartment comprises a retaining member which remains connected to the at least one cartridge upon detachment of the at least one detachable storage compartment from the cap of the at least one cartridge.

4. The container assembly of claim 1, wherein the liquid-containing compartment releases a liquid into the interior of the container upon detachment of the at least one detachable storage compartment into the interior of the container.

5. The container assembly of claim 1, wherein the solid-containing compartment comprises the perforated grill exposing a solid material contained in the solid-containing compartment to a fluid in the interior of the container.

6. The container assembly of claim 1, wherein the threads on the inner surface of the cap and the threads on the outer surface of the threaded neck are counter-threaded.

7. The container assembly of claim 1, wherein the at least one detachable storage compartment contains a material that is activatable against pests.

8. The container assembly of claim 1, wherein the liquid-containing compartment is fluidly separated from the solid-containing compartment by an impermeable bottom floor of the liquid-containing compartment.

9. The container assembly of claim 1, wherein the least one outwardly protruding rib that engages the catch is formed on an outer surface of the liquid-containing compartment.

10. The container assembly of claim 1, wherein the container further comprises a pump-action detachable nozzle or spout engaged to the container, and the hollow interior is at least partially fillable with liquid.

11. The container assembly of claim 1, wherein the liquid is an oil, acid, solvent, or aqueous solution.

12. The container assembly of claim 1, wherein the liquid is a surfactant, emulsifier, sticker, pesticide, microbicide, herbicide, or any combinations thereof.

13. The container assembly of claim 1, wherein the solid is a powder, tablet, pellet, granule, flake, crystal, or any combinations thereof.

14. The container assembly of claim 1, wherein solid is a surfactant, emulsifier, sticker, pesticide, microbicide, herbicide, or any combinations thereof.

15. The container assembly of claim 1, wherein solid comprises a pesticide and the liquid is oil, surfactant, or combinations thereof.

16. The container assembly of claim 15, wherein the pesticide is azadirachtin A.

* * * * *

UNITED STATES PATENT AND TRADEMARK OFFICE

CERTIFICATE OF CORRECTION

PATENT NO. : 7,938,258 B2
APPLICATION NO. : 11/543557
DATED : May 10, 2011
INVENTOR(S) : Saravanane et al.

It is certified that error appears in the above-identified patent and that said Letters Patent is hereby corrected as shown below:

ON THE COVER PAGE, ITEM (75):

Change "Senravan Ramasamy" to --Senrayan Ramasamy--.

IN THE CLAIMS:

Column 9, Claim 1, lines 51-60, should read:

--wherein the at least one detachable storage compartment comprises at least one liquid-containing compartment which further includes liquid and at least one solid-containing compartment which further includes a solid, wherein the at least one liquid-containing compartment and the at least one solid-containing compartment <u>are separably joined by inter-engaging members</u> and the liquid-containing compartment being fluidly separated from the at least one solid-containing compartment; and--

Signed and Sealed this
Twenty-eighth Day of June, 2011

David J. Kappos

David J. Kappos
*Director of the United States Patent and Trademark Office*